US007309178B2

(12) United States Patent
Ikeda

(10) Patent No.: US 7,309,178 B2
(45) Date of Patent: Dec. 18, 2007

(54) IMAGE FORMATION DEVICE

(75) Inventor: Akihiro Ikeda, Obu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/165,207

(22) Filed: Jun. 24, 2005

(65) Prior Publication Data

US 2005/0286951 A1 Dec. 29, 2005

(30) Foreign Application Priority Data

Jun. 25, 2004 (JP) ..... 2004-188229

(51) Int. Cl.
*B41J 33/14* (2006.01)

(52) U.S. Cl. ..... 400/232; 400/218; 400/230; 242/412.1; 347/215; 347/217

(58) Field of Classification Search ..... None
See application file for complete search history.

(56) References Cited

U.S. PATENT DOCUMENTS 3,442,366 A * 5/1969 Spears ..... 400/234
4,414,555 A * 11/1983 Becker ..... 347/217
4,527,172 A 7/1985 Nagashima et al.
4,878,773 A * 11/1989 Mazumder ..... 400/234
5,245,354 A 9/1993 Ono et al.
5,502,477 A * 3/1996 Osada et al. ..... 347/176
6,315,471 B1 * 11/2001 Hsieh et al. ..... 400/234

FOREIGN PATENT DOCUMENTS

| | | |
|---|---|---|
| JP | 5-12154 | 2/1993 |
| JP | 5-51665 U | 7/1993 |
| JP | 10-226130 A | 8/1998 |
| JP | 2001-270206 A | 10/2001 |

* cited by examiner

*Primary Examiner*—Jill E. Culler
(74) *Attorney, Agent, or Firm*—Banner & Witcoff, Ltd.

(57) ABSTRACT

An image formation device (facsimile machine, printer, copier, etc.) is provided, which is capable of reducing the amount of ink ribbon rolled up for the removal of slack of the ribbon. When a ribbon roll-up process is started, the operation mode of the image formation device is first set to a ribbon roll-up mode in which a ribbon roll-up spool is driven without driving a platen. The slack of the ribbon is removed by driving the ribbon roll-up spool to roll up the ribbon without driving the platen, which can reduce the amount of ribbon rolled up for the removal of the slack (the amount of ribbon wasted).

7 Claims, 14 Drawing Sheets

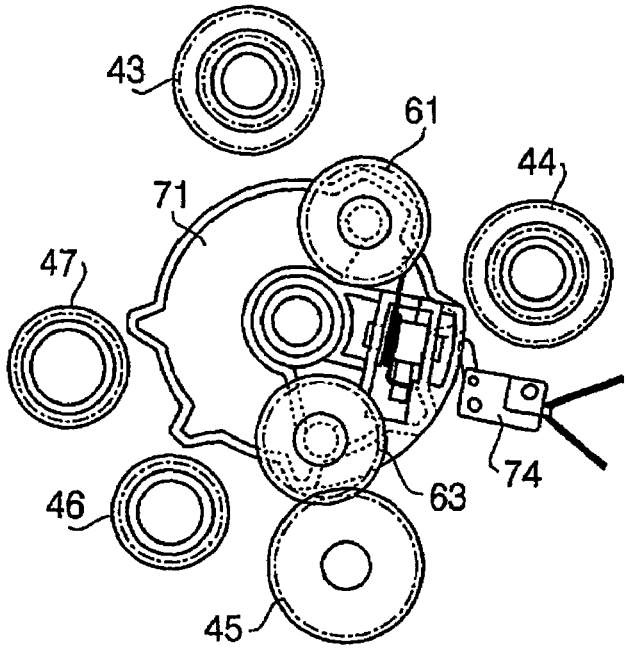
FIG.11A RIBBON ROLL-UP MODE
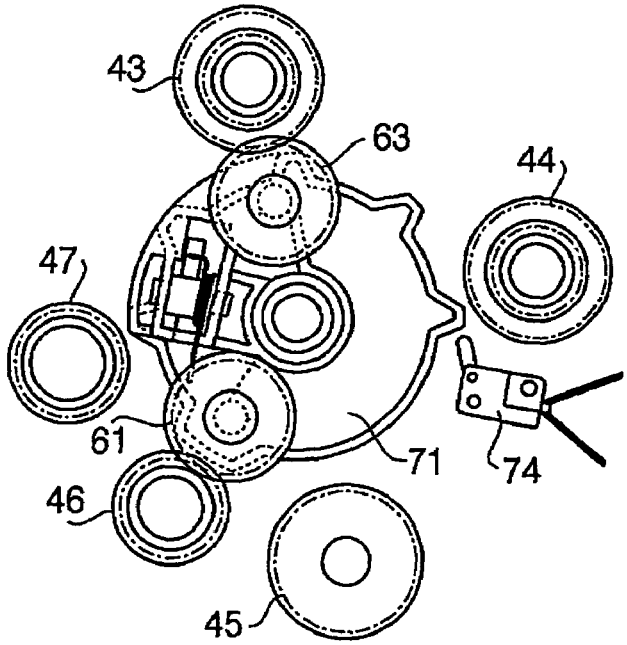
FIG.11B RECORDING MODE

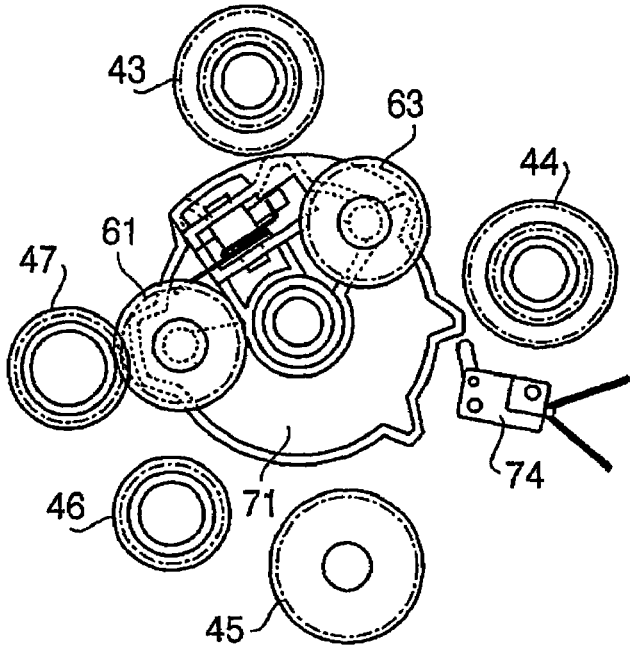
FIG.12A SHEET FEED MODE
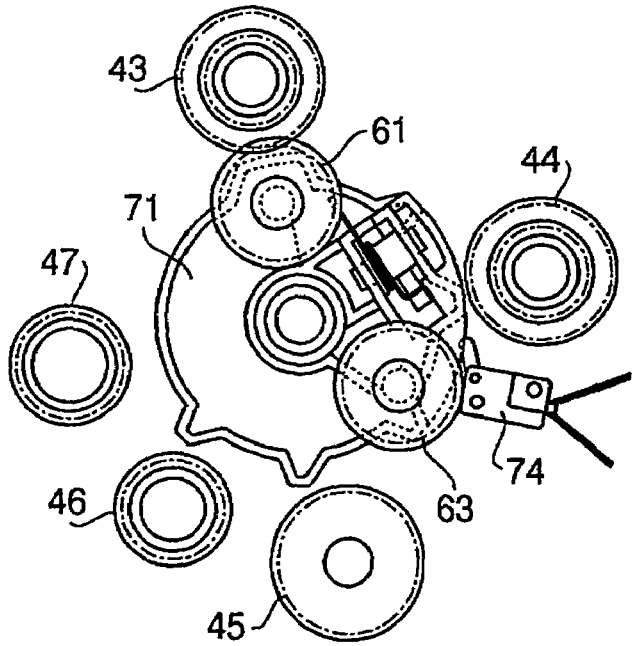
FIG.12B SHEET EJECTION MODE

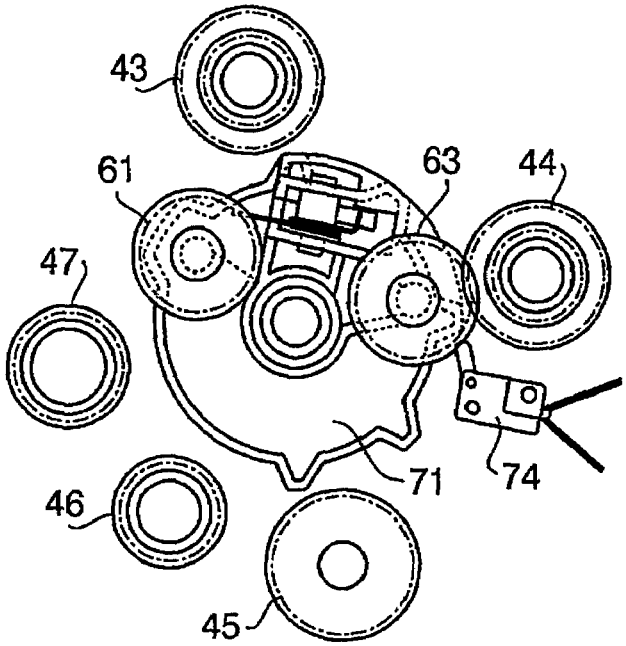
FIG.13A DOCUMENT READING MODE
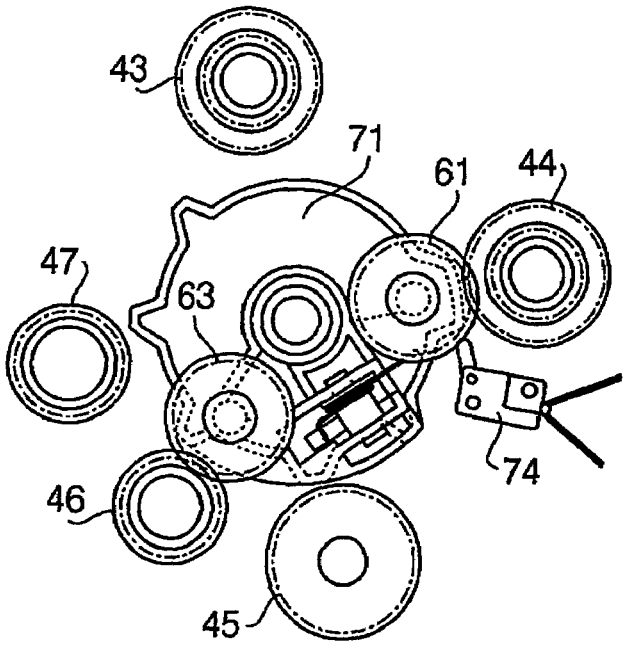
FIG.13B COPY MODE

IMAGE FORMATION DEVICE

CROSS-REFERENCE TO RELATED APPLICATION

This application claims priority under 35 U.S.C. § 119 from Japanese Patent Application No. 2004-188229, filed on Jun. 25, 2004, the entire subject matters of the application being incorporated herein by reference.

BACKGROUND

The present invention relates to image formation devices such as facsimile machines, printers and copiers.

Various types of image formation devices (facsimile machines, printers, copiers, etc.), forming images on print media (paper, OHP sheets, labels, etc.), are in wide use today. For the image formation devices, techniques for forming images using a ribbon coated with ink have long been well known. In such techniques, removal of slack occurring to the ribbon from various causes is one of serious challenges.

A technique for removing the slack of the ribbon has been employed for an image formation device including a recording head driving unit (for driving and switching a recording head between a head-up state and a head-down state) and an ink ribbon feeding unit (for feeding an ink ribbon of an ink ribbon cassette) both mounted on a carriage (which can hold the ink ribbon cassette) and being capable of driving both the recording head driving unit and the ink ribbon feeding unit with a single driving source. In the technique, the slack of the ink ribbon is removed by feeding the ink ribbon after the recording head is moved up (in the head-up state) in addition to the feeding of the ink ribbon in the head-down state (see Japanese Patent Provisional Publication No. HEI10-226130, for example).

Even in image formation devices having no function of moving the recording head up/down, the slack occurs to the ribbon when the ribbon is replaced, for example. In image formation devices of a well known type, the ribbon is stored in a ribbon cassette having two spools, and ink on the ribbon is transferred to a recording medium (paper, etc.) fed between the recording head and a platen while the ribbon is pulled out from one spool and rolled up by the other spool. In such image formation devices, the slack tends to occur when the ribbon cassette is attached and detached to/from the image formation device.

It is possible to apply the above-described technique to the image formation devices of the above type to remove the slack of the ribbon. Specifically, after the ribbon cassette is set to the image formation device, the slack of the ribbon can be removed by separating the recording head and the platen from each other and rolling up the ribbon.

However, in order to realize the method, a mechanism for separating the recording head and the platen from each other has to be installed in the image formation device, which substantially adds to the complexity of the device. Providing the image formation device with such a separating mechanism (which is originally unnecessary) in order to remove the slack of the ribbon is not a realistic approach in terms of reducing the size and cost of the device.

In another known method for removing the slack of the ribbon in an image formation device having no function of moving the recording head up/down, when an upper cover of the image formation device is closed, the platen roller is driven (rotated) while the driving force is transmitted also to a ribbon roll-up part so as to drive both the platen roller and the ribbon roll-up part and thereby remove the slack of the ribbon (see U.S. Pat. No. 4,527,172 (hereinafter referred to as "the '172 patent"), for example).

While the method of the '172 patent is capable of removing the slack of the ribbon, the method of rotating both the ribbon roll-up part and the platen for the removal of the slack, causes the ribbon roll-up to increase in length and an increased amount of ribbon to be wasted without being used for image formation.

Specifically, in the image formation device configured as above, the platen roller is rotated at a constant speed for image formation and a roll-up speed of the ribbon roll-up part is generally set higher than a feeding speed of the platen roller in consideration of a gradual increase of a roll-up diameter of the ribbon roll-up part as the ribbon is rolled up. The slack of the ribbon is removed by driving the platen roller (facing the recording head) and the ribbon roll-up part of the ribbon cassette, that is, by operating the platen roller and the ribbon roll-up part in the same way as in the image formation.

Consequently, the rotation of the ribbon roll-up part for the removal of the slack is necessarily accompanied by rotation of the platen roller, and a new part of the ribbon is necessarily pulled out and supplied by the platen roller resulting in a large amount of new ribbon being wasted.

SUMMARY

The present invention has been made in consideration of the above problems. In at least some aspects an image formation device capable of reducing the amount of ink ribbon rolled up during the removal of the slack of the ribbon can be provided.

BRIEF DESCRIPTION OF THE ACCOMPANYING DRAWINGS

FIG. 11A is a schematic diagram showing the principal part of the driving force transmission mechanism in a ribbon roll-up mode according to an illustrative aspect of the present invention;

FIG. 11B is a schematic diagram showing the principal part of the driving force transmission mechanism in a recording mode according to an illustrative aspect of the present invention;

FIG. 12A is a schematic diagram showing the principal part of the driving force transmission mechanism in a sheet feed mode according to an illustrative aspect of the present invention;

FIG. 12B is a schematic diagram showing the principal part of the driving force transmission mechanism in a sheet ejection mode according to an illustrative aspect of the present invention;

FIG. 13A is a schematic diagram showing the principal part of the driving force transmission mechanism in a document reading mode according to an illustrative aspect of the present invention;

FIG. 13B is a schematic diagram showing the principal part of the driving force transmission mechanism in a copy mode according to an illustrative aspect of the present invention.

DETAILED DESCRIPTION

General Overview

Figure 1:
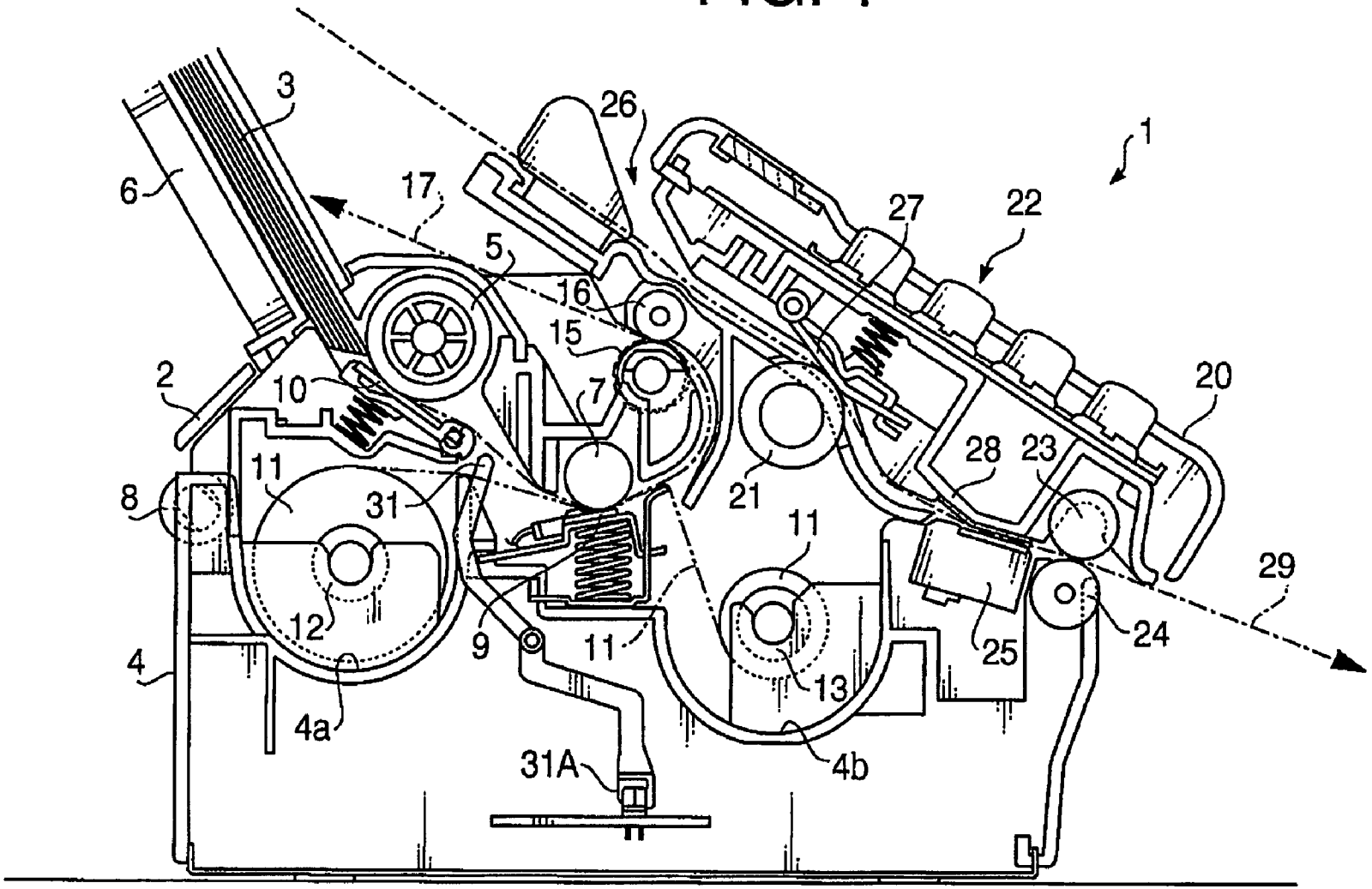
FIG. 1 is a sectional side view showing the overall composition of a facsimile machine as an image formation device in accordance with an illustrative embodiment of the present invention.

The method of the '172 patent results in heavy consumption of ribbon since the method removes the slack of the ribbon by operating the platen roller and the ribbon roll-up part in the same way as in the image formation. The heavy consumption of ribbon can be avoided by preventing ribbon from being supplied during the removal of the slack.

In accordance with an aspect of the present invention, there is provided an image formation device comprising a ribbon supply unit storing a rolled ribbon having ink on its surface, a ribbon roll-up unit which rolls up the ribbon supplied from the ribbon supply unit, a recording unit placed between the ribbon supply unit and the ribbon roll-up unit to form an image on a recording medium by making contact with a back of the ribbon and transferring the ink from the surface of the ribbon to the recording medium, and a feeding unit placed to face the recording unit via the ribbon to feed the recording medium, which is sandwiched between the surface of the ribbon and the feeding unit. The image formation device may be configured so that the ribbon roll-up unit can be driven without allowing the feeding unit to operate.

In the image formation device configured as above, the slack of the ribbon can be removed by driving the ribbon roll-up unit to roll up the ribbon while preventing the feeding unit from operating. With such a configuration, the amount of ribbon rolled up by the ribbon roll-up unit during the removal of the slack of the ribbon (the amount of ribbon wasted) can be reduced when compared to conventional methods that drive both the ribbon roll-up unit and the feeding unit (e.g. platen roller) to remove the slack.

Operation modes of the image formation device may include at least a ribbon roll-up mode in which the ribbon roll-up unit rolls up the ribbon while the feeding unit does not feed the recording medium. In the ribbon roll-up mode, a roll-up control unit drives the ribbon roll-up unit without allowing the feeding unit to operate.

In the image formation device configured as above, by setting the operation mode to the ribbon roll-up mode, the roll-up control unit may drive the ribbon roll-up unit without allowing the feeding unit to operate, which may result in the amount of ribbon rolled up by the ribbon roll-up unit during the removal of the slack being reduced when compared to conventional methods that drive both the ribbon roll-up unit and the feeding unit (e.g. platen roller) to remove the slack.

Specifically, the roll-up control unit may include a driving force generation unit, a driving force transmission unit and a control unit. The driving force generation unit generates driving force for driving the ribbon roll-up unit. The driving force transmission unit transmits the driving force from the driving force generation unit to the ribbon roll-up unit without transmitting the driving force to the feeding unit. The control unit drives the ribbon roll-up unit without allowing the feeding unit to operate in the ribbon roll-up mode by allowing the driving force transmission unit to transmit the driving force from the driving force generation unit to the ribbon roll-up unit in the ribbon roll-up mode.

In an illustrative embodiment, the feeding unit feeds the recording medium while the ribbon roll-up unit is driven so that roll-up speed of the ribbon will be a first roll-up speed higher than a feeding speed of the recording medium when the image formation on the recording medium is executed by the recording unit. In the ribbon roll-up mode, the roll-up control unit drives the ribbon roll-up unit so that the ribbon will be rolled up at a second roll-up speed higher than the first roll-up speed.

In the image formation device configured as above, the ribbon roll-up unit in the ribbon roll-up mode is driven at the second roll-up speed higher than the first roll-up speed used for the image formation on the recording medium, which results in a further reduction of the time necessary to remove the slack of the ribbon.

In another illustrative embodiment, the image formation device comprises a main body on which at least the ribbon roll-up unit and the ribbon supply unit are attached detachably, and a cover configured to be openable and closable with respect to the main body and to be able to cover the ribbon roll-up unit and the ribbon supply unit when it is closed. The operation mode of the image formation device is set to the ribbon roll-up mode when the cover is closed to cover the ribbon roll-up unit and the ribbon supply unit after the cover is opened to expose the ribbon roll-up unit and the ribbon supply unit.

In the image formation device configured as above, the operation mode is set to the ribbon roll-up mode and a ribbon roll-up process (removal of the slack of the ribbon) is executed automatically when the cover is opened and closed for replacement of the ribbon (in many cases, a ribbon cassette containing the ribbon, the ribbon supply unit and the ribbon roll-up unit is replaced at once), etc. With such a configuration problems occurring when the user forgets to remove the slack of the ribbon can be eliminated.

In another illustrative embodiment, the operation modes of the image formation device further include a recording mode in which both the feeding unit and the ribbon roll-up unit operate, and the image formation device further comprises a ribbon detection unit which detects whether the ribbon exists between the ribbon supply unit and the feeding unit. The operation mode of the image formation device is preliminarily set to the recording mode for a prescribed period before the operation mode is set to the ribbon roll-up mode. The operation mode is not set to the ribbon roll-up mode when no ribbon is detected by the ribbon detection unit during the prescribed period in the recording mode.

In the image formation device configured as above, execution of an unnecessary process (driving the ribbon detection unit for removing the slack when no ribbon has been set) can be avoided.

In a further aspect, the image formation device further comprises a drive restriction unit which stops driving the ribbon roll-up unit when a load on the ribbon roll-up unit exceeds a prescribed limit load less than a load, which is breaking the ribbon.

In the image formation device configured as above, the driving of the ribbon roll-up unit is prevented by the drive restriction unit when a heavy load which risks the breaking of the ribbon is applied. This configuration can prevent the breakage of the ribbon from occurring due to an excessive load.

In accordance with another aspect of the present invention, there is provided an image formation device comprising a ribbon supply unit storing a rolled ribbon having ink on its surface, a ribbon roll-up unit which rolls up the ribbon supplied from the ribbon supply unit, a recording unit placed between the ribbon supply unit and the ribbon roll-up unit to form an image on a recording medium by making contact with a back of the ribbon and transferring the ink from the surface of the ribbon to the recording medium, a feeding unit placed to face the recording unit via the ribbon to feed the recording medium sandwiched between the surface of the ribbon and the feeding unit, and a roll-up control unit which drives both the ribbon roll-up unit and the feeding unit in a recording mode for forming the image on the recording medium while driving the ribbon roll-up unit without driving the feeding unit in a ribbon roll-up mode to remove the slack of the ribbon.

In the image formation device configured as above, the roll-up control unit drives both the ribbon roll-up unit and the feeding unit in the recording mode (for forming images on recording mediums) while driving the ribbon roll-up unit without driving the feeding unit in the ribbon roll-up mode (for removing the slack of the ribbon). With this configuration, the amount of ribbon rolled up by the ribbon roll-up unit during the removal of the slack of the ribbon (the amount of ribbon wasted) can be reduced when compared to conventional methods that drive both the ribbon roll-up unit and the feeding unit (e.g. platen roller) to remove the slack.

EMBODIMENT

Referring now to the drawings, a description will be given in detail of an illustrative embodiment in accordance with the present invention.

FIG. 1 is a sectional side view showing the overall configuration of a facsimile machine 1 as an image formation device in accordance with an illustrative embodiment of the present invention. In FIG. 1, the front of the facsimile machine 1 is shown on the right-hand side and the rear is shown on the left-hand side. As shown in FIG. 1, the facsimile machine 1 has an upper cover 2 and a lower cover 4. A sheet tray 6 is provided to an upper-rear part of the upper cover 2, and a stack of sheets 3 (e.g. paper, OHP sheets, labels, etc.) as recording media are set in the sheet tray 6. Each sheet 3 is fed along a sheet feed path 17 (indicated by an arrow in FIG. 1) by rollers, etc. which will be explained later.

The upper cover 2 and the lower cover 4 are linked with a cover rotation shaft 8 (at the rear ends of the covers 2 and 4) to be rotatable around the cover rotation shaft 8. When the user of the facsimile machine 1 opens the upper cover 2 by operating a lever (not shown), the upper cover 2 rotates counterclockwise around the cover rotation shaft 8, which also causes various components mounted on the upper part of the facsimile machine 1 (the sheet tray 6, a sheet feed roller 5, a platen 7, a sheet ejection roller 15, an ADF (Automatic Document Feeder) roller 21, an LF (Line Feed) roller 23, a keyboard 22, etc.) to rotate around the cover rotation shaft 8 together with the upper cover 2.

The sheet feed roller 5, driven and rotated by a drive motor M (shown in FIG. 7) and gears which will be explained later, feeds the sheets 3 set in the sheet tray 6 one by one along the sheet feed path 17 in cooperation with a regulating member 10.

On the downstream side of the sheet feed roller 5 in the sheet feed path 17, the platen 7 is placed. The platen 7 is also driven and rotated by the drive motor M and gears which will be explained later. Under the platen 7, a recording head 9 (for forming an image on the sheet 3 by transferring ink from a ribbon 11 to the sheet 3) is placed to face the platen 7. The recording head 9, designed as the so-called line thermal head, includes a plurality of heating elements arranged in a line, which can allow the recording head 9 to cover the whole printable range of the sheet 3.

Incidentally, the recording head 9 is mounted and fixed on the lower part of the facsimile machine 1 (inside the lower cover 4) together with a ribbon supply part 4*a*, a ribbon roll-up part 4*b*, a CIS (Contact Image Sensor) 25, a document ejection pinch roller 24, a ribbon sensor 31, etc. which will be explained later. Therefore, when the upper cover 2 is opened, the recording head 9 stands still while the platen 7 separates from the recording head 9.

On the downstream side of the platen 7 in the sheet feed path 17, the sheet ejection roller 15 (for ejecting the sheet 3 having an image formed thereon from the facsimile machine 1) is placed. Over the sheet ejection roller 15, a sheet ejection pinch roller 16 is placed to press against the sheet ejection roller 15.

The sheet ejection roller 15 is also driven and rotated by the drive motor M and gears which will be explained later. The sheet ejection roller 15, in cooperation with the sheet ejection pinch roller 16, feeds the sheet 3 (after the image formation) downstream along the sheet feed path 17, by which the sheet 3 is ejected from the facsimile machine 1.

Meanwhile, when a document to be transmitted by the facsimile machine 1 is inserted into a document inlet 26, the document is fed along a document feed path 29 by the ADF roller 21 and the LF roller 23. Specifically, the document inserted into the document inlet 26 is first fed by the ADF roller 21. Over the ADF roller 21, a separating member 27 is placed to make slight contact with the top of the ADF roller 21. The separating member 27 prevents multi feed of the document being fed by the ADF roller 21, by successively separating a lowermost sheet of the document from a stack of sheets of the document. Therefore, the document inserted into the document inlet 26 is fed sheet by sheet along the document feed path 29 by the ADF roller 21 in cooperation with the separating member 27.

On the downstream side of the ADF roller 21 in the document feed path 29, the CIS 25 is placed. Over the CIS 25, a document holder 28 is provided so as to press against the top face of the CIS 25. The CIS 25 successively reads an image on each sheet of the document while the sheet fed along the document feed path 29 passes between the CIS 25 and the document holder 28.

On the downstream side of the CIS 25, the LF roller 23 and the document ejection pinch roller 24 (under the LF roller 23) are rotatably placed to press against each other. The LF roller 23 and the document ejection pinch roller 24 eject the document (after the image reading by the CIS 25) from the facsimile machine 1.

The aforementioned keyboard 22, having numeric keys and various function keys, is provided to a top panel 20 of the facsimile machine 1. The user can instruct the facsimile machine 1 to perform various operations by pressing the keys on the keyboard 22. The top panel 20 is also provided with a display unit (not shown) for displaying the operating status of the facsimile machine 1 to the user.

On the lower cover 4, the ribbon supply part 4*a* is formed below the sheet feed roller 5 while the ribbon roll-up part 4*b* is formed below the ADF roller 21. The ribbon supply part 4*a* stores the ribbon 11 which has been rolled up around a ribbon supply spool 12. The ribbon 11 is pulled out from the ribbon supply part 4*a*, passes between the recording head 9 and the platen 7, and is rolled up by a ribbon roll-up spool 13 of the ribbon roll-up part 4*b*.

Incidentally, both the ribbon supply spool 12 and the ribbon roll-up spool 13 in this embodiment are attached to a cassette frame (not shown) to form one ribbon cassette. The ribbon cassette is configured to be attachable and detachable to/from the lower cover 4. However, such a configuration of the ribbon cassette is only an example, and thus the ribbon supply spool 12 and the ribbon roll-up spool 13 may also be configured to be independently attached/detached to/from the lower cover 4.

The ribbon 11 is made wide enough to cover a recordable range of the heating elements of the recording head 9 configured as a line thermal head. The ribbon roll-up spool 13, driven and rotated by the drive motor M and gears which will be explained later, rolls up the ribbon 11 which has been used for the image formation on the sheet 3.

In the facsimile machine 1 of this embodiment configured as above, the sheet 3 is fed by the sheet feed roller 5 to the position between the recording head 9 and the platen 7, and an image is formed on the sheet 3 by transferring the ink on the ribbon 11 onto the sheet 3. The image formation on the sheet 3 is carried out by the recording head 9 while the platen 7 rotates to feed the sheet 3 and the ribbon roll-up spool 13 rolls up the ribbon 11 supplied from the ribbon supply spool 12. The sheet 3 on which the image has been formed as above is fed upward along the sheet feed path 17 and is ejected from the facsimile machine 1 by the sheet ejection roller 15. Meanwhile, the document to be transmitted by the facsimile machine 1 is fed by the ADF roller 21 along the document feed path 29, read by the CIS 25, and ejected from the facsimile machine 1 by the LF roller 23.

Figure 2A:
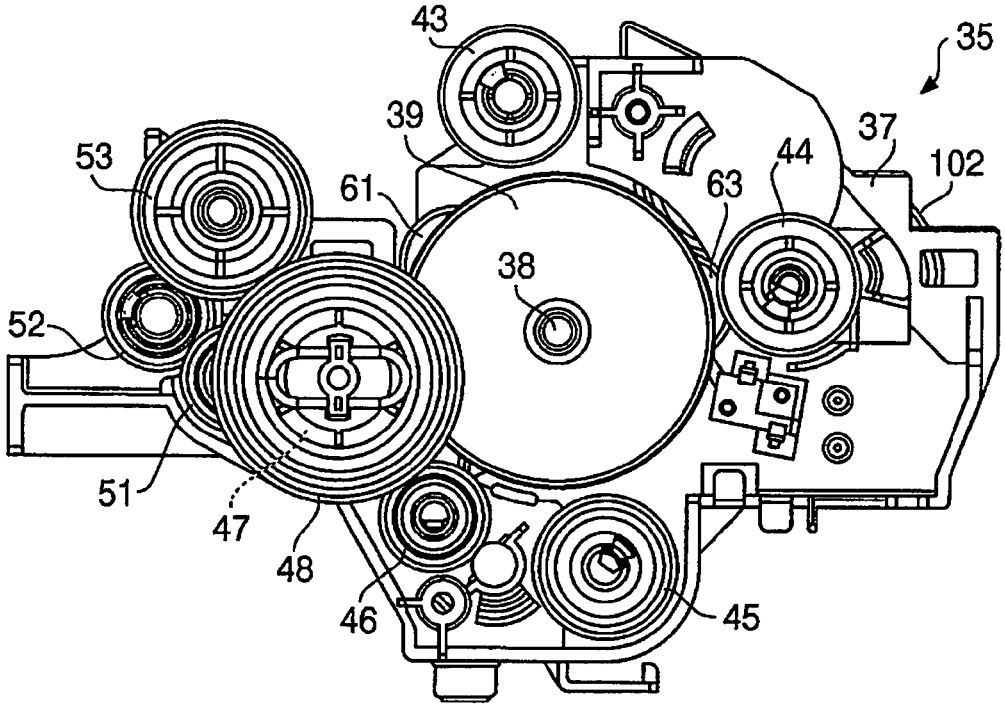
FIGS. 2A and 2B are schematic diagrams showing the overall configuration of an illustrative driving force transmission mechanism of the facsimile machine of FIG. 1.
Figure 2B:
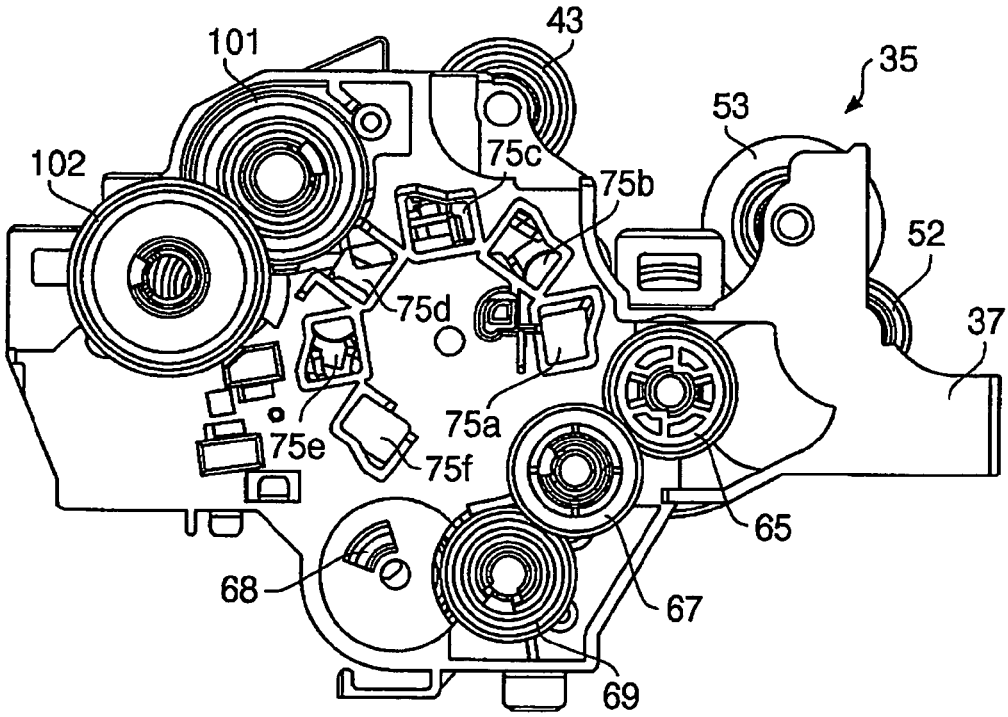

In the following, a driving force transmission mechanism for selectively driving and rotating the sheet feed roller 5, the platen 7, the ribbon roll-up spool 13, the sheet ejection roller 15, the ADF roller 21 and the LF roller 23 will be explained referring to FIGS. 2A and 2B. The driving force transmission mechanism 35 shown in FIGS. 2A and 2B is placed in front of the ribbon roll-up spool 13, etc. in FIG. 1, that is, on the left-hand side of the facsimile machine 1 when seen from the front of the machine (i.e. when seen from the right of FIG. 1). Incidentally, FIG. 2A views the driving force transmission mechanism 35 from the same direction as FIG. 1, while FIG. 3B views the driving force transmission mechanism 35 from the opposite side.

The driving force transmission mechanism 35 includes a drive frame 37, a sun gear 39 rotating around a shaft 38, a first drive gear 43, a second drive gear 44, a third drive gear 45, a fourth drive gear 46 and a fifth drive gear 47 as main components. In FIG. 2A, the fifth drive gear 47 is hiding behind a friction gear 48.

Figure 6:
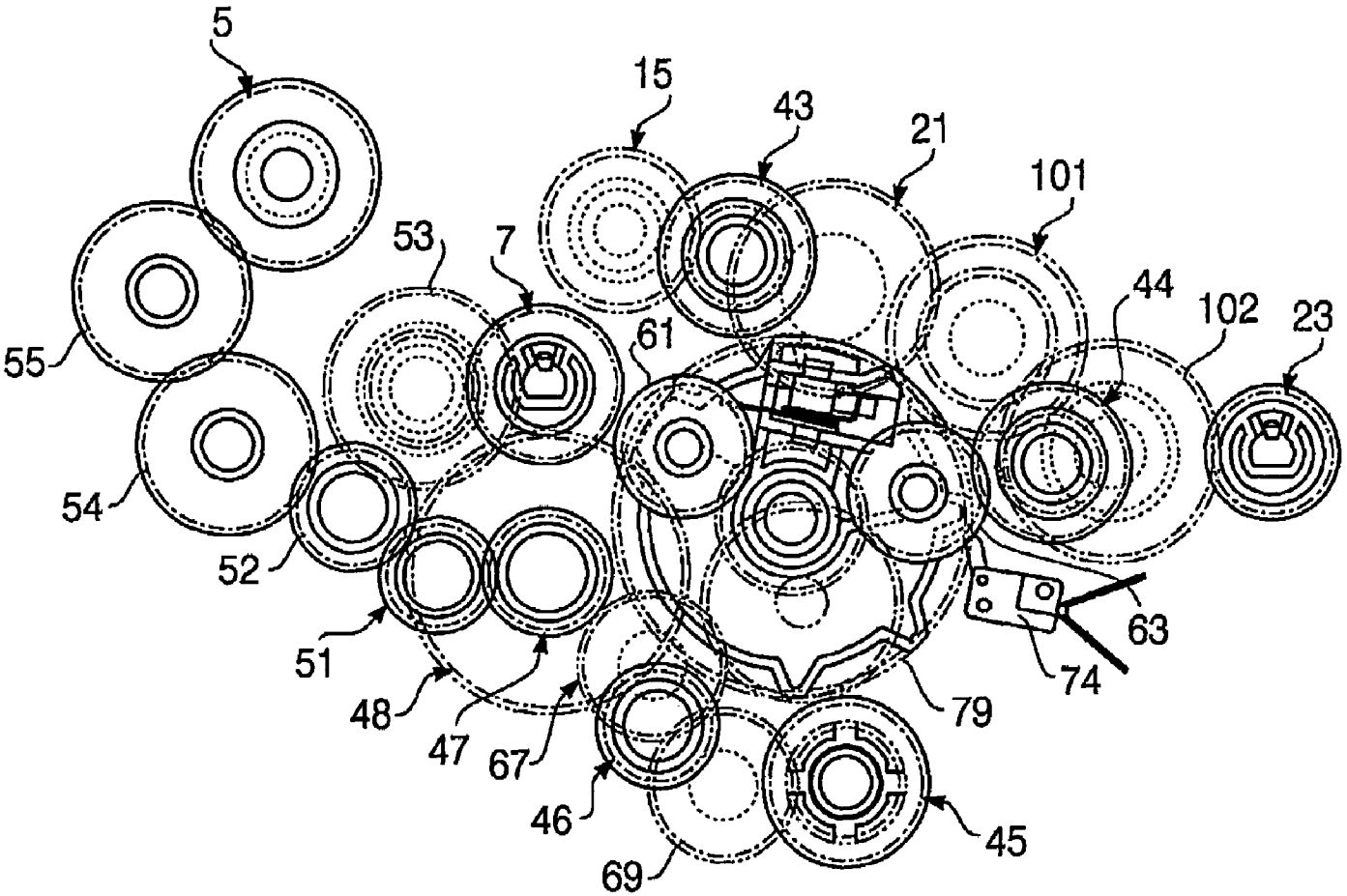
FIG. 6 is a schematic diagram showing a mechanism for transmitting driving force from the rotary member to each roller of the facsimile machine according to an illustrative aspect of the present invention.

A first drive gear 51 and a second drive gear 52 are gears for transmitting the driving force, which has been transmitted to the fifth drive gear 47, to the sheet feed roller 5 (see FIG. 6). A ribbon drive idle gear 65 is linked with the friction gear 48 (see FIG. 8B). A ribbon drive gear 67 engages with the ribbon drive idle gear 65 and another ribbon drive idle gear 69. A fifth drive gear 68 is linked with the third drive gear 45 via a clutch spring 87 which transmits the driving force for rolling up the ribbon 11 (hereinafter referred to as a "roll-up force transmission clutch spring 87") (see FIG. 8C). The roll-up force transmission clutch spring 87 will be explained later. The ribbon drive idle gear 69 engages with the ribbon drive gear 67 and the fifth drive gear 68.

A first planetary gear 61 and a second planetary gear 63 are gears provided to a rotary member 71 (coaxial with the sun gear 39) which will be explained later (see FIG. 3). A reduction gear 53 is a gear for transmitting the driving force of the friction gear 48 to the platen 7 (see FIG. 6). A sixth drive gear 101 and a seventh drive gear 102 are gears for transmitting the driving force of the second drive gear 44 to the ADF roller 21 and the LF roller 23, respectively. The details of the gears will be described later. Locating holes 75*a*-75*f* are used for specifying the driving state (operation mode) of the driving force transmission mechanism 35.

Figure 3:
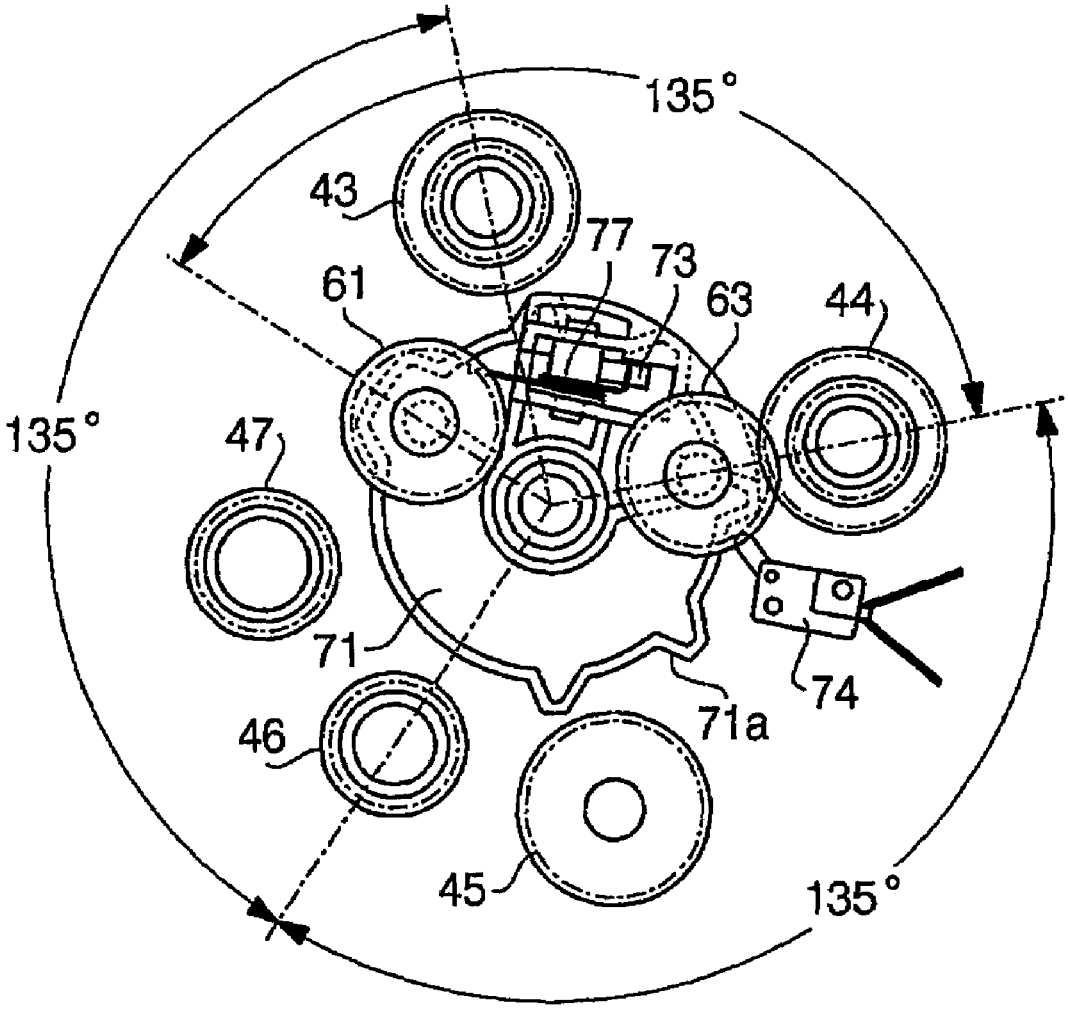
FIG. 3 is a schematic diagram showing a principal part of a driving force transmission mechanism of the facsimile machine in a document reading state.

FIG. 3 is a schematic diagram showing a principal part of the driving force transmission mechanism 35 (excluding the sun gear 39, etc. from FIG. 2A). The rotary member 71 is coaxially linked with the sun gear 39 via a clutch spring 76 (hereinafter referred to as a "main clutch spring 76") which will be explained later. The periphery 71*a* of the rotary member 71 is formed to have projections and depressions. A sensor switch 74 detects the angle of the rotary member 71 (operation mode) by sensing the projections and depressions.

The rotary member 71 is provided with two planetary gears: the first and second planetary gears 61 and 63. When a small-diameter gear 72 (see FIG. 4B) formed integrally with the sun gear 39 rotates in a direction, the first and second planetary gears 61 and 63 rotate in the reverse direction, that is, opposite to the small-diameter gear 72. The centers of the first and second planetary gears 61 and 63 are arranged to form an angle of 135 degrees with respect to the center of the rotary member 71 (i.e. the center of the sun gear 39). The angle formed by the centers of the second and fourth drive gears 44 and 46 with respect to the center of the rotary member 71 (the center of the sun gear 39) is also 135 degrees. Similarly, the angle formed by the centers of the fourth and first drive gears 46 and 43 with respect to the center of the rotary member 71 (the center of the sun gear 39) is also 135 degrees. By such gear arrangement, a "recording mode" and a "copy mode" which will be explained later are realized. Incidentally, FIG. 3 shows a state in which the operation mode has been set to a "document reading mode", with the second planetary gear 63 and the second drive gear 44 engaged with each other. The above angles (135 degrees) are only a specific example, and thus the angles can be varied as long as intended operation modes can be realized.

Figure 4A:
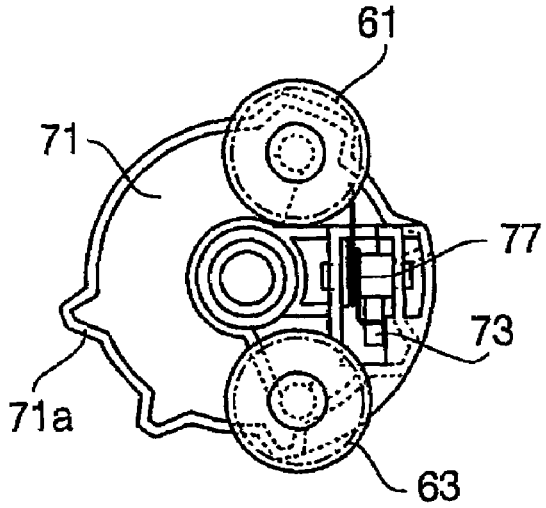
FIGS. 4A-4C are schematic diagrams showing an illustrative rotary member of the driving force transmission mechanism.
Figure 4C:
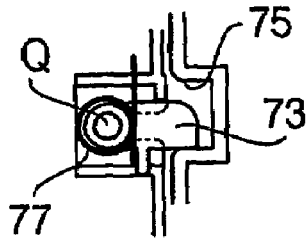
Figure 4B:
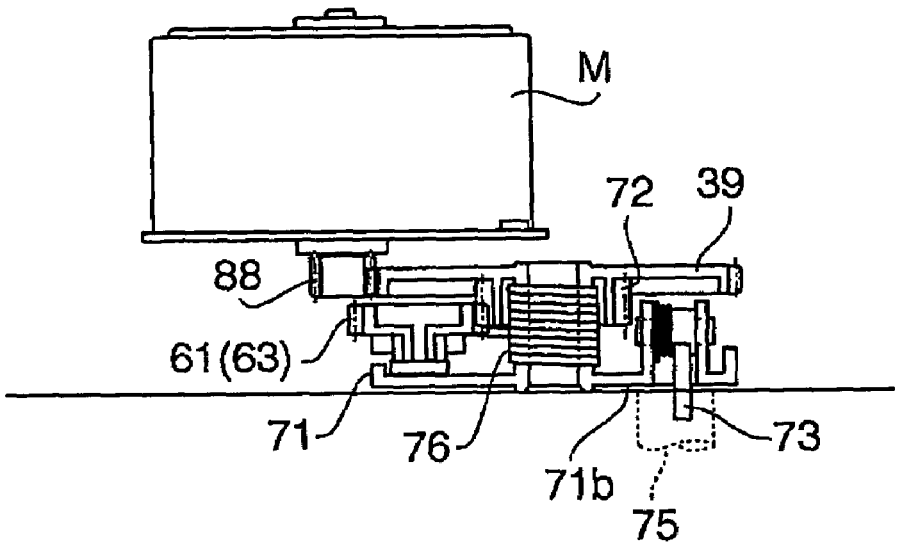

FIGS. 4A-4C show a driving mechanism, etc. of the rotary member 71, in which FIG. 4A is a schematic diagram viewing the rotary member 71 from the same direction as FIG. 3, FIG. 4B is a side view of the rotary member 71 and the driving mechanism, and FIG. 4C is a side view viewing the rotary member 71 from the right of FIG. 4A for explaining a pawl 73. The locating hole 75 shown in FIGS. 4B and 4C denotes an arbitrary one of the aforementioned locating holes 75*a*-75*f*. FIG. 4C shows a state in which the pawl 73 has engaged with a locating hole 75 (one of the locating holes 75*a*-75*f*).

As shown in FIG. 4B, the sun gear 39 is placed to be rotated by the driving force of the drive motor M via a motor gear 88. Between the sun gear 39 and the rotary member 71, the aforementioned main clutch spring 76 is placed. The main clutch spring 76 links the sun gear 39 with the rotary member 71 by causing strong torque (tightened torque) when the sun gear 39 rotates in its normal direction (counterclockwise in FIG. 4A). Due to the linkage by the main clutch spring 76, the rotary member 71 rotates according to the rotation of the sun gear 39 until a projection/depression formed on the periphery 71*a* of the rotary member 71 is certainly detected by the sensor switch 74 (not shown in FIGS. 4A-4C, see FIG. 3).

On the other hand, when the sun gear 39 rotates in the reverse direction (clockwise in FIG. 4A), the sun gear 39 and the rotary member 71 are linked together by weak torque (loosened torque) caused by the main clutch spring 76, which causes the sun gear 39 and the rotary member 71 to rotate together until the pawl 73 engages with a locating hole 75. Once the pawl 73 has engaged with the locating hole 75, the linkage between the sun gear 39 and the rotary member 71 is released due to slippage of the main clutch spring 76, which causes the rotary member 71 to stop rotating while the sun gear 39 keeps on rotating. In this case of reverse rotation, the rotary member 71 is rotated by the loosened torque (weak torque) of the main clutch spring 76; therefore, the friction load caused by the slippage is small and the load on the drive motor M is low.

Incidentally, the rotary member 71 is rotated using the tightened torque (strong torque) of the main clutch spring 76 during the normal rotation of the sun gear 39 while using the loosened torque (weak torque) of the main clutch spring 76 during the reverse rotation of the sun gear 39 as explained above, for the reasons described below.

In this embodiment, the position of the rotary member 71 (determining the operation mode) is judged based on the number of pulses (of the drive motor M such as a stepping motor) in each OFF period detected by the sensor switch 74. Specifically, the rotary member 71 (drawn with solid lines and dotted lines in FIG. 3, for example) has six projections (including one wide projection) formed on its periphery 71*a*, and the sensor switch 74 is turned ON when it is pressed by each projection. Therefore, when the rotary member 71 makes one rotation at a constant speed, one long OFF period and five short OFF periods are detected by the sensor switch 74. A position where the long OFF period is detected is defined as a home position, and the position of the rotary member 71 (determining the operation mode) is judged based on the ON/OFF change of the sensor switch 74 when the rotary member 71 is rotated in the normal direction (counterclockwise) starting from the home position.

As above, during the normal rotation of the rotary member 71 (during operation mode setting), it is necessary to let the rotary member 71 rotate securely without slipping and to carry out the ON/OFF judgment by the sensor switch 74 and the counting of the number of pulses in each OFF period correctly. For this reason, the rotary member 71 is rotated in the normal direction by use of the tightened torque (strong torque) of the main clutch spring 76.

On the other hand, during the reverse rotation, it is desirable that no extra load (other than a prescribed load) be put on the drive motor M since the drive motor M is eventually required to drive a roller corresponding to the current operation mode with its driving force. For this reason, the rotary member 71 is rotated in the reverse direction by use of the loosened torque (weak torque) of the main clutch spring 76. By such a configuration, after the pawl 73 has engaged with a locating hole 75, only the slipping frictional force of the loosened torque (an extremely low load) is put on the drive motor M, which results in the load on the drive motor M being reduced considerably when compared to the case where the tightened torque (strong torque) is applied to the drive motor M as the load.

The pawl 73 is provided on the rotary member 71 approximately at the midpoint between the first planetary gear 61 and the second planetary gear 63. The pawl 73 is mounted on the rotary member 71 to be swingable around an axis Q as shown in FIG. 4C so that its tip will protrude from the lower face 71*b* of the rotary member 71 as shown in FIG. 4B. The pawl 73, formed substantially in a rectangular shape with a lower right corner when seen from the outside of the rotary member 71 (upper right corner in FIG. 4C) having a curvature radius (R) larger than that of a lower left corner (lower right corner in FIG. 4C), is biased counterclockwise in FIG. 4C by a torsion spring 77 (the counterclockwise rotation of the pawl 73 is restricted by the lower face 71*b* of the rotary member 71). By the engagement of the pawl 73 with a locating hole 75 (one of the locating holes 75*a*-75*f*) as shown in FIG. 4C, the operation mode of the driving force transmission mechanism 35 is specified.

Figure 5A:
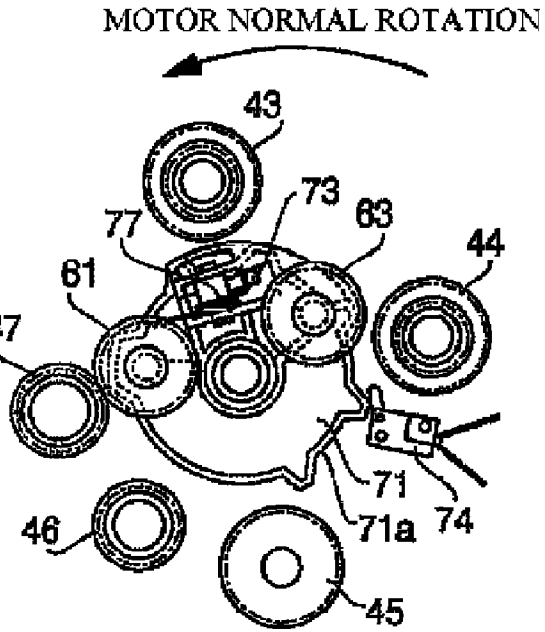
FIGS. 5A-5D are schematic diagrams showing the relationship between a pawl and the rotation of the rotary member according to an illustrative aspect of the present invention.
Figure 5B:
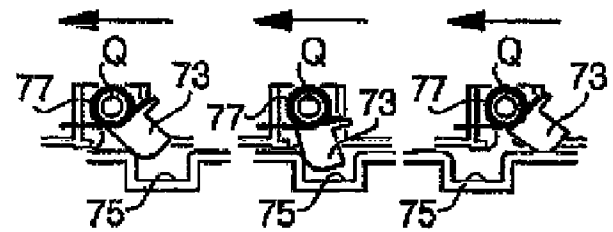

FIGS. 5A-5D are schematic diagrams showing the relationship between the pawl 73 and the rotation of the rotary member 71. When the rotary member 71 is rotated counterclockwise (normal rotation) as shown in FIG. 5A, the sun gear 39 and the rotary member 71 rotate together and the operation mode changes successively as explained above. In this case, the state of the pawl 73 changes as shown in FIG. 5B.

FIG. 5B shows the state of the pawl 73 viewed from the center of the rotary member 71 (i.e. the center of the sun gear 39). Along with the normal rotation of the rotary member 71, the state of the pawl 73 changes from the right to the left of FIG. 5B. Specifically, when the pawl 73 is not directly facing a locating hole 75 of the drive frame 37 as shown at the right of FIG. 5B, the corner of the pawl 73 having the larger curvature radius R (round corner) stays on the top surface of the drive frame 37. When the pawl 73 directly faces the locating hole 75, the pawl 73 enters the locating hole 75. However, as the rotary member 71 is rotated further in the same direction, the round corner of the pawl 73 slides up the left wall of the locating hole 75 as shown at the center of FIG. 5B and then gets out of the locating hole 75 as shown at the left of FIG. 5B. In this sequence, the sensor switch 74 which has stayed ON is turned OFF and then turned ON again by the projections and depressions formed on the periphery 71*a* of the rotary member 71.

The second ON state corresponds to the state of the pawl 73 at the left of FIG. 5B. At this moment, the current rotation angle (position) of the rotary member 71 can be detected. Specifically, the position where the long OFF period is detected (while the sensor switch 74 changes like ON→OFF→ON due to the projections and depressions formed on the periphery 71*a* of the rotary member 71) is defined as the home position, and the rotation angle (position) of the rotary member 71 is detected based on the number of ON→OFF changes of the sensor switch 74 starting from the home position, as mentioned before.

Figure 5C:
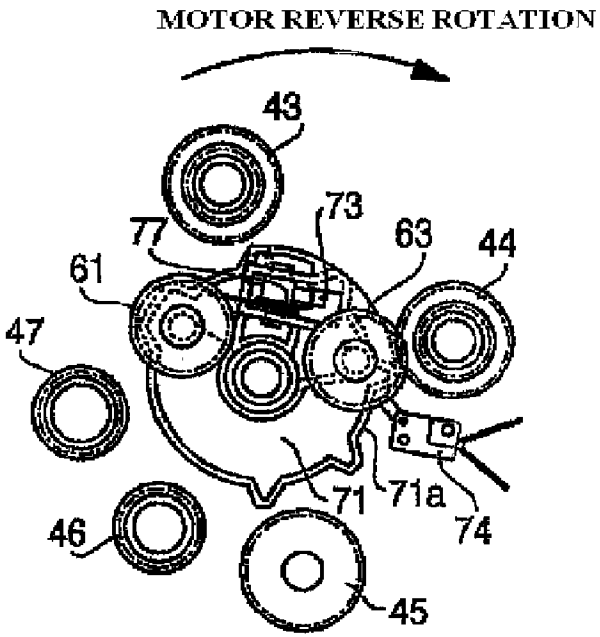

After a prescribed rotation angle of the rotary member 71 is detected from the ON→OFF→ON change of the sensor switch 74 (i.e. after a prescribed projection has passed by the sensor switch 74), the rotary member 71 is rotated clockwise (reverse rotation) as shown in FIG. 5C. After the sun gear 39 starts the reverse rotation, the rotary member 71 is rotated together with the sun gear 39 due to the loosened torque of the main clutch spring 76 as mentioned above such that the pawl 73 engages with a locating hole 75 (one of the locating holes 75*a*-75*f*). By the engagement of the pawl 73 with a locating hole 75, the operation mode is fixed.

Figure 5D:
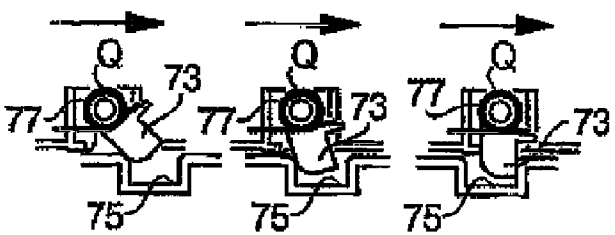

When the rotary member 71 is rotated in the reverse direction from the state shown at the left of FIG. 5B, the state of the pawl 73 changes as shown in FIG. 5D. While FIG. 5D shows the state of the pawl 73 seen from the center of the rotary member 71 (i.e. the center of the sun gear 39) similarly to FIG. 5B, the state of the pawl 73 changes from the left to the right of FIG. 5D according to the reverse rotation of the rotary member 71.

Specifically, when the pawl 73 is not directly facing a locating hole 75 of the drive frame 37 as shown at the left of FIG. 5D, the round corner of the pawl 73 stays on the top surface of the drive frame 37. When the pawl 73 moves rightward relative to the drive frame 37 due to the reverse rotation of the rotary member 71, the pawl 73 biased by the torsion spring 77 enters the locating hole 75 as shown at the center of FIG. 5D. When the rotary member 71 is rotated further in the same direction, the square side of the pawl 73 makes contact with the right wall of the locating hole 75.

In this state shown at the right of FIG. 5D, even if the reverse rotation is continued, the pawl 73, sandwiched between the lower face 71*b* of the rotary member 71 and the right wall of the locating hole 75, is fixed and can not get out of the locating hole 75, such that the position of the rotary member 71 is fixed (i.e. the operation mode is fixed). After the fixation of the rotary member 71, even if the sun gear 39 is rotated by the drive motor M in the reverse direction, the main clutch spring 76 slips and the rotary member 71 does not rotate any more.

Figure 7:
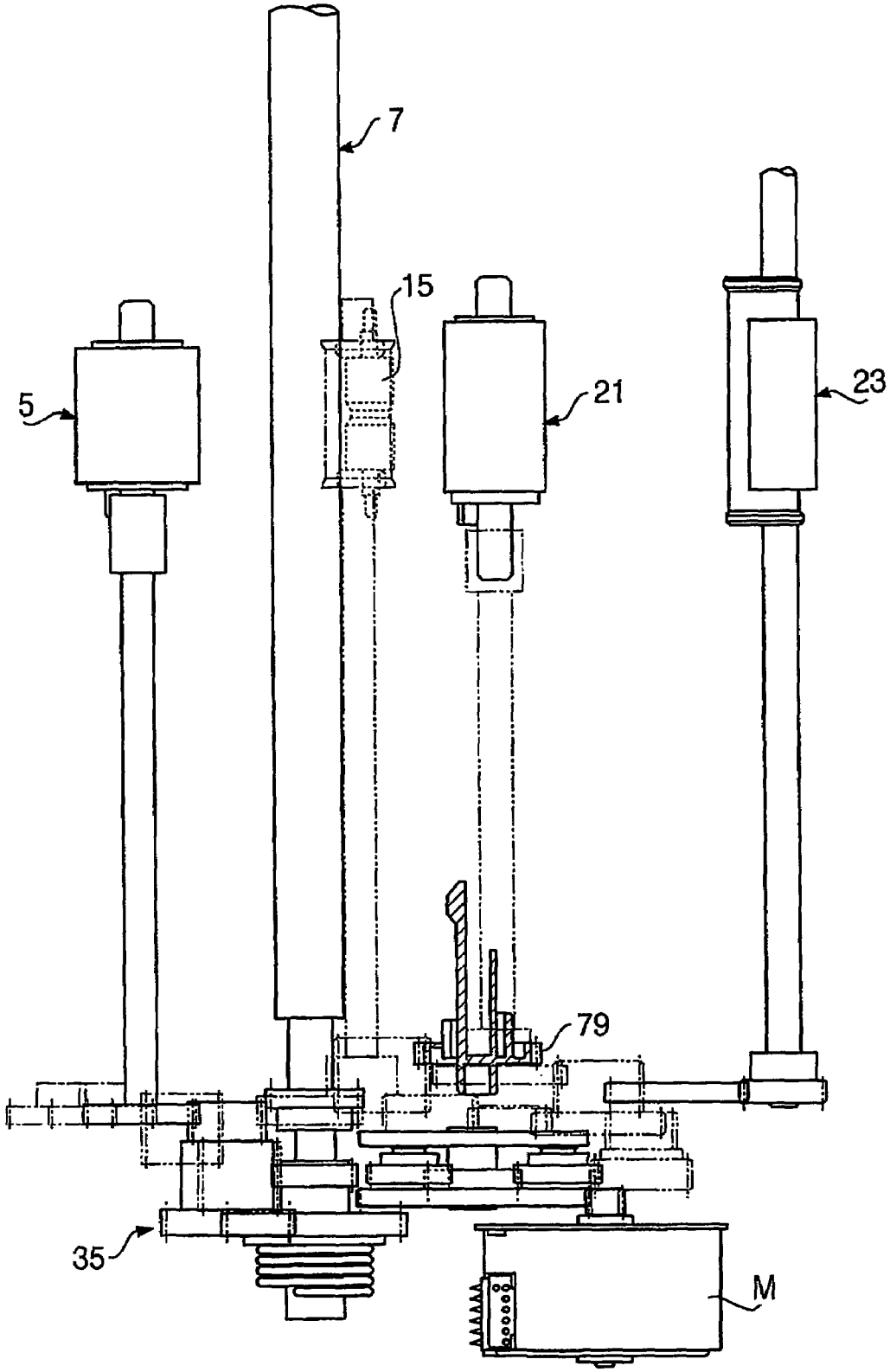
FIG. 7 is a schematic diagram showing the arrangement of the driving force transmission mechanism and rollers inside the facsimile machine according to an illustrative aspect of the present invention.

FIGS. 6 and 7 show the positional/mechanical relationship among the gears explained above (driving force transmission mechanism 35) and the rollers, etc. which have been explained referring to FIG. 1. Incidentally, while the driving force transmitted to the platen 7 is first received by a gear (platen gear) which is provided coaxially with the platen 7, the figures are drawn using the reference numeral "7" of the platen also for the platen gear as if the platen 7 were directly driven by the driving force transmitted by the aforementioned gears, for the sake of simplicity (ditto for gears of other rollers).

When the first drive gear 43 is driven by the first planetary gear 61 or the second planetary gear 63, the sheet ejection roller 15 is driven.

When the second drive gear 44 is driven by the first planetary gear 61 or the second planetary gear 63, the sixth drive gear 101 is driven, which causes the ADF roller 21 to be driven and the LF roller 23 to be also driven via the seventh drive gear 102.

When the third drive gear 45 is driven by the second planetary gear 63, the driving force is successively transmitted to the fifth drive gear 68 (see FIG. 2B), the ribbon drive idle gear 69, the ribbon drive gear 67, a ribbon cassette gear 79 and the ribbon roll-up spool 13, which causes the ribbon roll-up spool 13 to be driven.

While the above driving force is also transmitted to the ribbon drive idle gear 65 provided coaxial with the friction gear 48 (see FIGS. 2B and 8B) so as to rotate the friction gear 48, the friction gear 48 does not rotate due to slippage between the ribbon drive idle gear 65 and the friction gear 48 as will be explained later. The ribbon cassette gear 79 is a gear formed coaxially and integrally with the ribbon roll-up spool 13 (see FIG. 1); therefore, the ribbon roll-up spool 13 rotates together with the ribbon cassette gear 79 when the driving force is transmitted to the ribbon cassette gear 79.

When the fourth drive gear 46 is driven by the first planetary gear 61 or the second planetary gear 63, the driving force is successively transmitted to the friction gear 48, the ribbon drive idle gear 65 (see FIG. 2B), the ribbon drive gear 67, the ribbon cassette gear 79 and the ribbon roll-up spool 13, which causes the ribbon roll-up spool 13 to be driven. Meanwhile, the driving force of the friction gear 48 is transmitted also to the reduction gear 53, which also causes the platen 7 to be also driven.

When the fifth drive gear 47 is driven by the first planetary gear 61, the driving force is successively transmitted to the first drive gear 51, the second drive gear 52, a third drive gear 54, a fourth drive gear 55 and the sheet feed roller 5, which causes the sheet feed roller 5 to be driven.

Figure 8A:
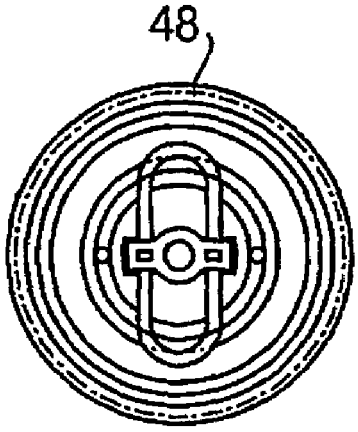
FIGS. 8A-8C are schematic diagrams explaining a friction gear and a third drive gear of the driving force transmission mechanism according to an illustrative aspect of the present invention.
Figure 8B:
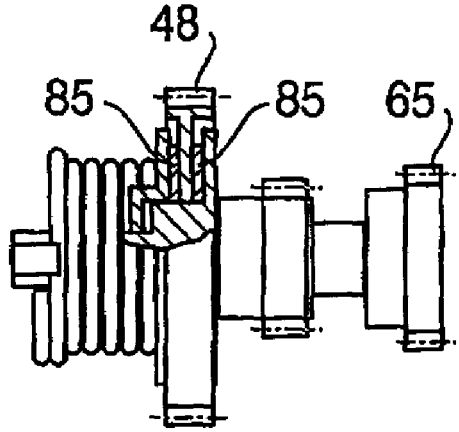

The friction gear 48 will be explained in detail below referring to FIGS. 8A and 8B. When the friction gear 48 is driven, the reduction gear 53 (see FIGS. 2A, 2B and 6) is driven, which causes the platen 7 to be driven. Meanwhile, according to the rotation of the friction gear 48, the ribbon drive idle gear 65 is rotated via a friction member 85. The driving force of the ribbon drive idle gear 65 is transmitted to the ribbon cassette gear 79 via the ribbon drive gear 67, which causes the ribbon roll-up spool 13 to be driven.

The gear ratio between the gear of the platen 7 and the ribbon drive idle gear 65 is set so that the ribbon roll-up spool 13 can roll up the ribbon 11 at a speed higher than the circumferential speed of the platen 7 irrespective of the amount of the ribbon rolled up (actually, such a high ribbon roll-up speed is prevented by the platen 7 and the ribbon 11 is rolled up at a speed specified by the circumferential speed of the platen 7).

With the above gear ratio setting, the ribbon roll-up speed attempted by the ribbon roll-up spool 13 can become too high since the roll-up diameter increases as the ribbon roll-up spool 13 rolls up the ribbon 11. Such excessive roll-up speed causes high tension of the ribbon 11 between the platen 7 and the ribbon roll-up spool 13 and breakage of the ribbon 11.

To avoid the problem, the friction member 85 is configured to cause slippage between the friction gear 48 and the ribbon drive idle gear 65 when prescribed force with no danger of breakage of the ribbon 11 (e.g. 5.9 N in terms of tension of the ribbon 11) is applied thereto. Therefore, in this embodiment, the ribbon roll-up force (caused by the friction of the friction member 85) is set to be smaller than the force rotating the platen 7, and both the ribbon roll-up force and the platen-rotating force are set to be smaller than the force breaking the ribbon 11. Thus, when the ribbon roll-up force becomes excessive, the friction member 85 starts slipping, which causes the ribbon drive idle gear 65 to stop rotating in spite of the rotation of the friction gear 48.

Figure 8C:
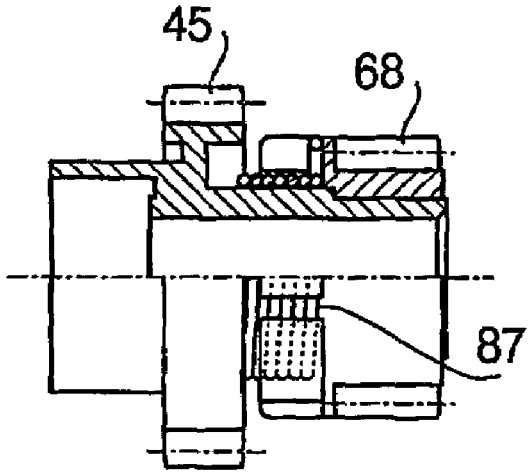

The ribbon drive gear 67 is driven not only when the driving force of the fourth drive gear 46 is transmitted thereto but also when the second planetary gear 63 engages with the third drive gear 45 (see FIG. 11A) as mentioned above. In this case, the fifth drive gear 68 (linked with the third drive gear 45 via the roll-up force transmission clutch spring 87 as shown in FIG. 8C) is driven so as to drive the ribbon drive idle gear 69 (engaging with the fifth drive gear 68), which causes the ribbon drive gear 67 to be driven.

The torque of the roll-up force transmission clutch spring 87 is set to be stronger than the friction of the friction member 85 and sufficiently weaker than the force breaking the ribbon 11. Therefore, the torque of the roll-up force transmission clutch spring 87 is not transmitted to the friction gear 48 and the ribbon roll-up spool 13 rotates with no rotation of the platen 7. As such, the ribbon 11 between the platen 7 and the ribbon roll-up spool 13 can be rolled up and the slack of the ribbon 11 can be removed.

Figure 9:
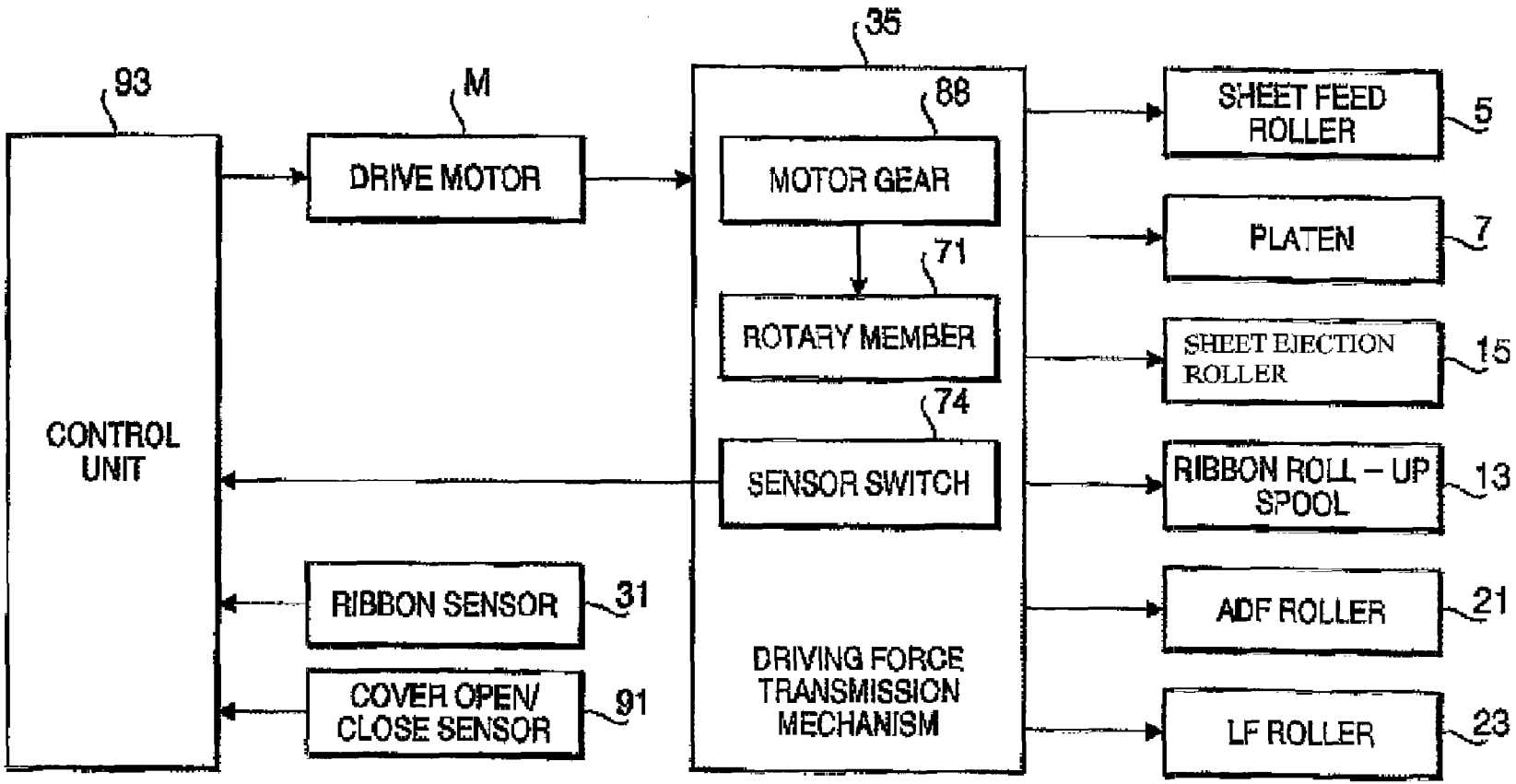
FIG. 9 is a block diagram showing the electrical composition of the facsimile machine according to an illustrative embodiment.

FIG. 9 is a block diagram showing the electrical composition of the facsimile machine 1. As shown in FIG. 9, the drive motor M, the sensor switch 74, the ribbon sensor 31 and a cover open/close sensor 91 are connected to a control unit 93 of the facsimile machine 1.

The control unit 93, for controlling the operation of the whole facsimile machine 1 including the driving force transmission mechanism 35, is implemented by a one-chip microcomputer, for example. Since this type of microcomputer is widely known to include a CPU as the center of control and operate according to programs stored in a ROM, data stored in a RAM, etc., illustration and explanation of the general composition of the microcomputer of the facsimile machine 1 is omitted here.

To the drive motor M, the motor gear 88 of the driving force transmission mechanism 35 (including the rotary member 71) is connected, as explained referring to FIG. 4B. The driving force transmission mechanism 35 is selectively linked to the sheet feed roller 5, the platen 7, the sheet ejection roller 15, the ribbon roll-up spool 13, the ADF roller 21 and the LF roller 23 depending on the operation mode.

Figure 10:
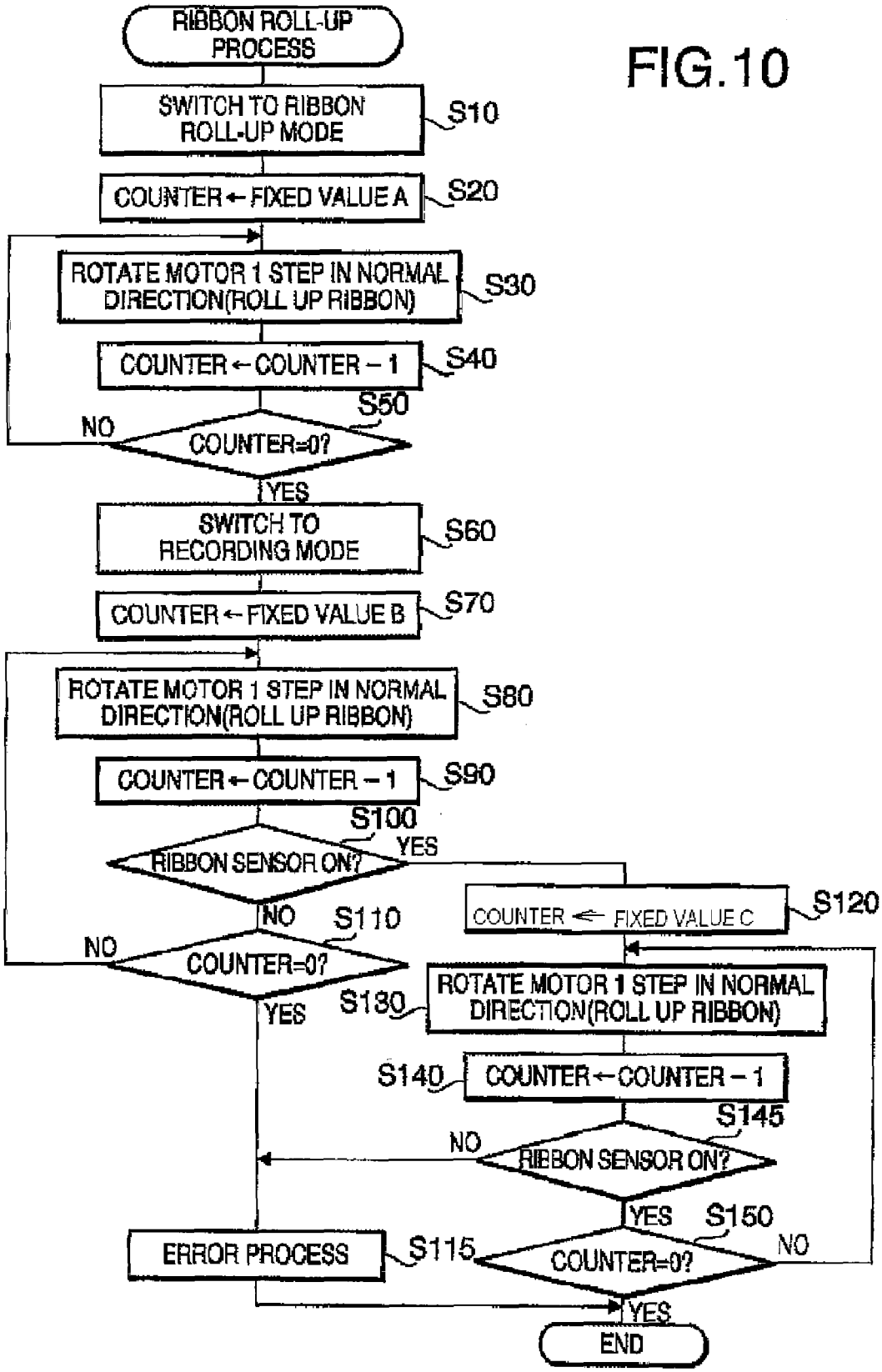
FIG. 10 is a flow chart showing a ribbon roll-up process executed by a control unit of the facsimile machine according to an illustrative aspect of the present invention.

In the following, a ribbon roll-up process executed by the control unit 93 will be described referring to FIG. 10. FIG. 10 is a flow chart showing the ribbon roll-up process executed by the CPU (not shown) of the control unit 93. The ribbon roll-up process is started when the cover open/close sensor 91 (see FIG. 9, not shown in FIG. 1) detects that the upper cover 2 is closed after being opened.

In the first step S10, the operation mode of the facsimile machine 1 is switched to a ribbon roll-up mode. Specifically, the rotary member 71 is properly rotated in the normal and reverse directions and the second planetary gear 63 is engaged with the third drive gear 45 as shown in FIG. 11A. In the next step S20, a counter configured in the RAM (not shown) is set to a fixed value A. In step S30, the drive motor M is rotated one step in the normal direction, which causes the ribbon roll-up spool 13 to be rotated one step without rotating the platen 7.

In the next step S40, the counter is decremented by 1 and thereafter the steps S30 and S40 are repeated until the counter is judged to be 0 (S50: YES). By the steps S20-S50, the drive motor M is rotated A (fixed value) steps in the normal direction. The fixed value A may be set to a value corresponding to a minimum rotation angle necessary for removing the slack of the ribbon 11.

In the next step S60, the operation mode of the facsimile machine 1 is switched to the recording mode. Specifically, the rotary member 71 is properly rotated in the normal and reverse directions and the first planetary gear 61 and the second planetary gear 63 are engaged with the fourth drive gear 46 and the first drive gear 43 respectively as shown in FIG. 11B.

FIG. 12A is a schematic diagram showing the principal part of the driving force transmission mechanism 35 in a sheet feed mode. In the sheet feed mode, the first planetary gear 61 engages with the fifth drive gear 47, which causes the sheet feed roller 5 to be driven.

FIG. 12B is a schematic diagram showing the principal part of the driving force transmission mechanism 35 in a sheet ejection mode. In the sheet ejection mode, the first planetary gear 61 engages with the first drive gear 43, which causes the sheet ejection roller 15 to be driven.

FIG. 13A is a schematic diagram showing the principal part of the driving force transmission mechanism 35 in the document reading mode. In the document reading mode, the second planetary gear 63 engages with the second drive gear 44, which causes the ADF roller 21 and the LF roller 23 to be driven.

FIG. 13B is a schematic diagram showing the principal part of the driving force transmission mechanism 35 in the copy mode. In the copy mode, the first planetary gear 61 and the second planetary gear 63 engage with the second drive gear 44 and the fourth drive gear 46 respectively, which causes the ADF roller 21, the LF roller 23, the ribbon roll-up spool 13 and the platen 7 to be driven. Incidentally, transmission paths of the driving force from the gears 43, 44, 45, 46 and 47 (driven by the planetary gears 61 and 63) to corresponding rollers have already been explained referring to FIG. 6, etc. and thus repeated explanation thereof is omitted here.

Referring again to FIG. 10, in the next step S70, the counter is set to a fixed value B (smaller than the fixed value A). In step S80, the drive motor M is rotated one step in the normal direction, which causes both the platen 7 and the ribbon roll-up spool 13 to be rotated one step. Subsequently, the counter is decremented by 1 (S90) and whether the ribbon sensor 31 (see FIG. 1) is ON or not is judged (S100).

The ribbon sensor 31 includes a member formed in an "L" like shape and placed between the ribbon supply part 4*a* and the platen 7. When the ribbon sensor 31 has been pressed down by the ribbon 11, a limit switch 31 A detects the ON state and the ribbon 11 is judged to have been set in the facsimile machine 1. If the ribbon sensor 31 is OFF (S100: NO), the process advances to step S110 and whether the counter is 0 or not is judged. The steps S80-S100 are repeated until the counter is judged to be 0 (S110: YES) or the ribbon sensor 31 turns ON (S100: YES). When the counter is judged to be 0 (S110: YES), an error process (e.g. informing the user that no ribbon 11 has been set) is executed (S115) and the ribbon roll-up process is ended.

When the ribbon sensor 31 is judged to be ON in the step S100 (S100: YES), the process advances to step S120 and the counter is set to a fixed value C (smaller than the fixed value B). In the next step S130, the drive motor M is rotated one step in the normal direction, which causes both the platen 7 and the ribbon roll-up spool 13 to be rotated one more step.

Subsequently, the counter is decremented by 1 (S140) and whether the ribbon sensor 31 is ON or not is judged (S145). If the ribbon sensor 31 is OFF (S145: NO), the process advances to the step S115 and the aforementioned error process is executed. If the ribbon sensor 31 is ON (S145: YES), the process advances to step S150 and whether the counter is 0 or not is judged. The steps S130-S145 are repeated until the counter is judged to be 0 (S150: YES) (or the ribbon sensor 31 turns OFF (S145: NO)). When the counter is judged to be 0 (S150: YES), the ribbon roll-up process is ended.

Even if the ribbon sensor 31 is erroneously judged (due to unexpected malfunction, etc.) to be ON (i.e. even if the ribbon 11 is erroneously judged to have been set) in the step S100 (S100: YES) when no ribbon 11 has actually been set, the absence of the ribbon 11 is detected (S145) unless the ribbon sensor 31 stays ON while the drive motor M is rotated C steps (S120-S150), which allows the presence/absence of the ribbon 11 to be judged correctly.

In the facsimile machine 1 configured as above, the ribbon roll-up spool 13 can be driven without driving the platen 7 by setting the operation mode to the ribbon roll-up mode. The slack between the platen 7 and the ribbon roll-up spool 13 is removed first and thereafter the slack between the ribbon supply spool 12 and the platen 7 is removed. Therefore, the amount of the ribbon 11 rolled up by the ribbon roll-up spool 13 from the ribbon supply spool 12 for the removal of the slack of the ribbon 11 can be reduced in comparison with conventional methods.

Since the ribbon roll-up process is executed automatically when the upper cover 2 is opened and closed (for replacement of the ribbon 11, etc.), trouble occurring when the user forgets to remove the slack of the ribbon 11 can be eliminated.

Further, since the roll-up force transmission clutch spring 87 (see FIG. 8C) is provided between the third drive gear 45 and the fifth drive gear 68, even when a heavy load that can break the ribbon 11 is applied, the rotation of the ribbon roll-up spool 13 is stopped securely and the ribbon 11 is prevented from breaking.

While a description has been given above of an illustrative embodiment in accordance with the present invention, the present invention is not to be restricted by the particular illustrative embodiment and a variety of modifications, design changes, etc. are possible without departing from the scope and spirit of the present invention described in the appended claims. For example, while the image formation device in accordance with the present invention is implemented as a facsimile machine 1 in the above embodiment, the image formation device may also be implemented as a copier, a printer, etc.

Figure 14:
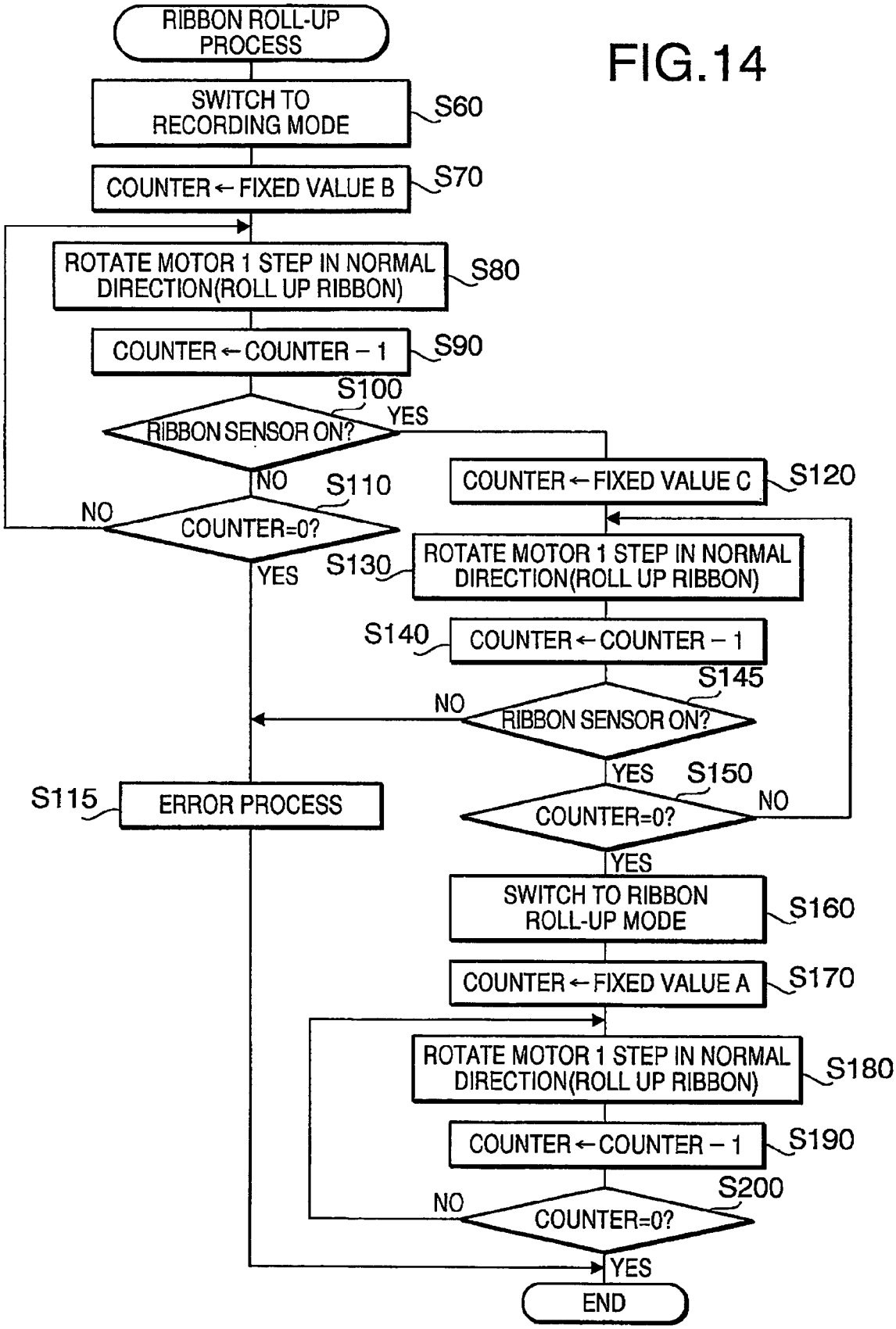
FIG. 14 is a flow chart showing another example of the ribbon roll-up process according to an illustrative aspect of the present invention.

The ribbon roll-up process of FIG. 10 may be modified into equivalent processes like the one shown in FIG. 14. The process of FIG. 14 is realized substantially by interchanging the steps S10-S50 and the steps S60-S150 in the ribbon roll-up process of FIG. 10. Especially, the steps S60-S150 are totally identical between FIGS. 10 and 14 (the same step numbers are used). Steps S160-S200 in FIG. 14 correspond to the steps S10-S50 in FIG. 10. A difference from the process of FIG. 10 caused by the change of the step order is that the process for removing the slack of the ribbon 11 is not executed (i.e. the process of FIG. 14 is ended without advancing to the step S160) when it is found that no ribbon 11 has been set (S110: YES, S145: NO), which avoids useless execution of unnecessary steps (driving the ribbon roll-up spool 13 for removing the slack when no ribbon 11 has been set).

The ribbon roll-up speed in the ribbon roll-up mode (S30 in FIG. 10, S180 in FIG. 14) may also be set faster than that in the regular recording mode. For example, the drive motor M may be rotated two steps (instead of one step) each time in the normal direction (in this case, the process advances from the step S50 to the step S60 if the counter is 0 or less), by which further reduces the time necessary for removing the slack of the ribbon 11.

It is also possible to use two separate motors for driving the platen 7 and the ribbon roll-up spool 13 respectively, without employing the driving force transmission mechanism 35 of the above embodiment. Also in this case, both the platen 7 and the ribbon roll-up spool 13 are driven in the recording mode while only the ribbon roll-up spool 13 is driven in the ribbon roll-up mode.

While the angle formed by the centers of the first and second planetary gears 61 and 63 with respect to the center of the rotary member 71 (i.e. the center of the sun gear 39) is set at 135 degrees in the above illustrative embodiment, the angle may be changed from 135 degrees. In such cases, the effects of the above illustrative embodiment can be achieved by rearranging the first through fifth drive gears 43-47.

What is claimed is:

1. An image formation device, comprising:

a ribbon supply unit for storing a rolled ribbon having ink on its surface;

a ribbon roll-up unit configured to roll up the ribbon supplied from the ribbon supply unit, a recording unit placed between the ribbon supply unit and the ribbon roll-up unit for forming an image on a recording medium by making contact with a back of the ribbon and transferring the ink from the surface of the ribbon to the recording medium, a feeding unit configured to face the recording unit via the ribbon for feeding the recording medium sandwiched between the surface of the ribbon and the feeding unit; and a roll-up control unit configured to drive the ribbon roll-up unit without allowing the feeding unit to operate in a ribbon roll-up mode, in which the ribbon roll-up unit rolls up the ribbon while the feeding unit does not feed the recording medium, wherein the feeding unit feeds the recording medium while the ribbon roll-up unit is driven so that a first roll-up speed of the ribbon will be greater than a feeding speed of the recording medium when the image formation on the recording medium is executed by the recording unit, and wherein the roll-up control unit drives the ribbon roll-up unit in the ribbon roll-up mode so that the ribbon will be rolled up at a second roll-up speed greater than the first roll-up speed.

2. The image formation device according to claim 1, wherein the roll-up control unit includes:

a driving force generation unit configured to generate driving force for driving the ribbon roll-up unit;

a driving force transmission unit configured to transmit the driving force from the driving force generation unit to the ribbon roll-up unit without transmitting the driving force to the feeding unit; and a control unit configured to drive the ribbon roll-up unit without allowing the feeding unit to operate in the ribbon roll-up mode by allowing the driving force transmission unit to transmit the driving force from the driving force generation unit to the ribbon roll-up unit in the ribbon roll-up mode.

3. The image formation device according to claim 1, further comprising:

a main body on which at least the ribbon roll-up unit and the ribbon supply unit are attached detachably; and a cover configured to be openable and closable with respect to the main body and configured to cover the ribbon roll-up unit and the ribbon supply unit when closed, wherein the image formation device is set to the ribbon roll-up mode when the cover is closed to cover the ribbon roll-up unit and the ribbon supply unit after the cover was opened to expose the ribbon roll-up unit and the ribbon supply unit.

4. The image formation device according to claim 1, wherein the image formation device further includes a recording mode in which both the feeding unit and the ribbon roll-up unit operate, wherein the image formation device further comprises a ribbon detection unit which detects whether the ribbon exists between the ribbon supply unit and the feeding unit, wherein the image formation device is set to the recording mode for a prescribed period before being set to the ribbon roll-up mode, and wherein the image formation device is not set to the ribbon roll-up mode when no ribbon is detected by the ribbon detection unit during the prescribed period in the recording mode.

5. The image formation device according to claim 1, further comprising a drive restriction unit which causes the driving of the ribbon roll-up unit to be prevented when a load on the ribbon roll-up unit exceeds a prescribed load threshold less than a load breaking the ribbon.

6. An image formation device, comprising:

a ribbon supply unit for storing a rolled ribbon having ink on its surface;

a ribbon roll-up unit configured to roll up the ribbon supplied from the ribbon supply unit;

a recording unit placed between the ribbon supply unit and the ribbon roll-up unit for forming an image on a recording medium by making contact with a back of the ribbon and transferring the ink from the surface of the ribbon to the recording medium;

a feeding unit configured to face the recording unit via the ribbon for feeding the recording medium sandwiched between the surface of the ribbon and the feeding unit; and a roll-up control unit configured to drive both the ribbon roll-up unit and the feeding unit in a recording mode for forming the image on the recording medium and configured to drive the ribbon roll-up unit without driving the feeding unit in a ribbon roll-up mode, in which the ribbon roll-up unit rolls up the ribbon while the feeding unit does not feed the recording medium, wherein the feeding unit feeds the recording medium while the ribbon roll-up unit is driven so that a first roll-up speed of the ribbon will be greater than a feeding speed of the recording medium when the image formation on the recording medium is executed by the recording unit, and wherein the roll-up control unit drives the ribbon roll-up unit in the ribbon roll-up mode so that the ribbon will be rolled up at a second roll-up speed greater than the first roll-up speed.

7. An image formation device comprising:

a ribbon supply unit that stores a rolled ribbon with a surface, where ink is provided on the surface;

a ribbon roll-up unit configured to roll up the ribbon supplied from the ribbon supply unit;

a recording unit located between the ribbon supply unit and the ribbon roll-up unit, the recording unit configured to form an image on a recording medium by making contact with a back of the ribbon and transferring the ink from the surface of the ribbon to the recording medium;

a feeding unit that faces the recording unit with respect to the ribbon, the feeding unit configured to feed the recording medium sandwiched between the surface of the ribbon and the feeding unit; and a roll-up control unit configured to drive the ribbon roll-up unit that, when in a ribbon roll-up mode, prevents the feeding unit from feeding the recording medium, wherein the feeding unit feeds the recording medium while the ribbon roll-up unit is driven so that a first roll-up speed of the ribbon will be greater than a feeding speed of the recording medium when the image formation on the recording medium is executed by the recording unit; and wherein the roll-up control unit drives the ribbon roll-up unit in the ribbon roll-up mode so that the ribbon will be rolled up at a second roll-up speed greater than the first roll-up speed.

* * * * *